United States Patent [19]

Freeman

[11] Patent Number: 5,042,402

[45] Date of Patent: Aug. 27, 1991

[54] MULTI-SIDED WATERCOOLED ROTARY COMBUSTOR

[75] Inventor: Lee H. Freeman, Loyalsock Township, Pa.

[73] Assignee: Tampella Keeler Incorporated, Williamsport, Pa.

[21] Appl. No.: 568,279

[22] Filed: Aug. 15, 1990

[51] Int. Cl.[5] ..... F27B 7/36

[52] U.S. Cl. ..... 110/246; 432/103

[58] Field of Search ..... 110/246; 432/103, 105, 432/112, 113

[56] References Cited

U.S. PATENT DOCUMENTS

| | | | |
|---|---|---|---|
| 518,285 | 4/1894 | Storer | 110/246 |
| 3,306,237 | 1/1964 | Ransom, Jr. | 110/14 |
| 3,408,969 | 11/1968 | Maurice | 110/14 |
| 3,431,684 | 3/1969 | Ban | 51/164 |
| 3,530,835 | 9/1970 | von Wiesenthal | 122/6 |
| 3,822,651 | 7/1974 | Harris et al. | 110/10 |
| 4,066,024 | 1/1978 | O'Connor | 110/8 F |
| 4,226,584 | 10/1980 | Ishikawa | 432/77 |
| 4,444,153 | 4/1984 | Smith | 122/2 |
| 4,735,157 | 4/1988 | Jurusz | 110/246 |
| 4,782,766 | 11/1988 | Lee et al. | 110/246 |
| 4,840,130 | 6/1989 | Quiel | 110/234 |
| 4,961,390 | 10/1990 | Whitlow et al. | 110/246 |

*Primary Examiner*—Henry C. Yuen

*Attorney, Agent, or Firm*—Ailes, Ohlandt & Greeley

[57] ABSTRACT

A watercooled rotary combustor comprising a plurality of pipes or tubes secured together, means mounting the plurality of pipes or tubes for rotation about the axis of the inner surface with the axis being horizontally tilted so as to have a high end and a low end, means for rotating the plurality of pipes or tubes on the mounting, a feeding chute into which burnable waste material can be stacked which opens into the high end of the combustor, the pipes or tubes being interconnected for circulating water flow and having a water input line and a watersteam discharge line, means for circulating water through the lines including a steam drum connected to the discharge line for separating steam from the water, the pipes or tubes being secured so as to define a plurality of intermediate openings so that the inner surface of the combustor is gas porous, and means for delivering controlled amounts of combustion air for burning through selected portions of the porous surface, the improvement comprising, a combustor formed by multiple flat membrane wall tube panels connected to each other such that the inner surface of the combustor is multi-sided.

2 Claims, 3 Drawing Sheets

MULTI-SIDED WATERCOOLED ROTARY COMBUSTOR

The present invention relates generally to a novel watercooled rotary combustor fabricated with membrane wall tube panels and having a multi-sided interior configuration. This combustor is used primarily in the incineration of refuse which results in steam generation as a form of energy.

BACKGROUND OF THE INVENTION

Proper disposal of solid waste has become an increasingly serious problem as existing sites for land disposal near capacity and new sites become increasingly difficult to locate. Incineration of combustible solid waste has long been used to reduce the quantity of solid matter needing disposal.

Watercooled rotary combustors have been developed to burn solid waste efficiently and economically. The heat energy which results from the burning of the solid waste is used to produce steam for use in generating electricity or for other industrial process uses. Various watercooled rotary combustors are described in U.S. Pat. Nos. 4,735,157 (Jurusz), which issued Apr. 5, 1988, 4,226,584 (Ishikawa), which issued Oct. 7, 1980, 4,066,024 (O'Connor), which issued Jan. 3, 1978, 3,822,651 (Harris et al.), which issued July 9, 1974, and 518,285 (Storer), which issued Apr. 17, 1894.

U.S. Pat. Nos. 3,822,651 (Harris et al.) and 4,735,157 (Jurusz) disclose a rotary kiln and combustor, respectively, each formed by a plurality of pipes joined to define an inner cylindrical surface and being interconnected to permit water flow through the pipes. During operation, burnable waste is dumped into one end of the rotary combustor. The combustor rotates and the burning waste slowly tumbles downwardly forming a kind of spiraling fire bed until what has not been consumed spills into the boiler.

Each of the aforementioned watercooled rotary combustors is designed with a cylindrical water tube cooled (membrane wall) combustor. (See FIG. 3 attached hereto). These combustors are fabricated of cylindrically welded walls consisting of water tubes and flat bars, i.e., the flat bars are disposed between and welded to adjoining tubes. The cylindrical welded wall is then welded into headers at each end. These cylindrical watercooled rotary combustors are installed having a downward slope towards the boiler.

During operation these combustors rotate at very slow speeds. The rotation and tilted axis convey the refuse or solid waste through the combustor and facilitates the mixing of the refuse during combustion. The bars (fins) of the membrane wall include perforations to admit forced draft combustion air. The combustion air is typically pre-heated and penetrates the burning refuse material.

Typically, refuse is fed into a cylindrical watercooled rotary combustor via a hopper at the upper inclined end and a hydraulically actuated ram-type feed system places the refuse into the combustor. The partially burned refuse, ash, and gases leave the combustor at the lower outlet end and into a boiler where completion of the combustion takes place in the radiant section of the boiler.

Combustion in an incinerator or combustor is greatly dependent upon maintenance of a continuous supply of air, i.e., oxygen, to support the burning reaction, and fast, complete combustion requires not only an adequate supply of air but also good mixing or distribution of the air through the desired combustion region.

The need for proper air flow is exemplified in U.S. Pat. No. 4,226,584 (Ishikawa). The Ishikawa patent discloses a rotary kiln similar to that set forth in U.S. Pat. No. 3,822,651. In an attempt to overcome restriction to the air flow within the kiln, a plurality of pins, secured directly to the pipes on the inside of the cylinder, were provided to create a pattern of projections to support burning material slightly spaced from the inner cylinder wall. The pins prevent air flow blockage and also increase the effective distribution of air under and through the combustion zone.

Although the pin design of the Ishikawa patent may aid in preventing blockage to the air flow in the combustor, it is extremely costly and time consuming to affix pins to the walls of each tube. Furthermore, the manufacturing techniques required in fabricating cylindrically shaped combustors is also expensive and extremely labor intensive.

The present inventor has designed a novel multi-sided watercooled rotary combustor which avoids the increased manufacturing costs associated with a cylindrical watercooled combustor, while improving the mixing action of the refuse by causing an increase in the tumbling and agitation of the refuse. The multi-sided design is fabricated from membrane wall tube panels. These membrane wall tube panels can be manufactured with readily available automatic equipment.

The increased tumbling and agitation provided by the multi-sided design according to the present invention improves drying of the refuse and promotes better combustion efficiency. The breaking-up of the refuse by the increased tumbling and agitation results in clinker reduction. The improved mixing and agitation also reduces the need for pre-heated combustion air and minimizes clogging of the air ports.

Thus, the novel combustor design of the present invention results in substantial economic benefits due to its improved combustion efficiency, clinker reduction, reduced pre-heated combustion air requirements and reduced clogging of air ports. Furthermore, the combustor requires less maintenance which results in less down time and increased operation.

Finally, the multi-sided combustor design avoids the need for circular headers which facilitates every phase of header fabrication and eliminates all fabricating operations associated with bending of the header pipe.

Additional advantages of the present invention shall become apparent as described below.

SUMMARY OF THE INVENTION

A watercooled rotary combustor comprising a plurality of pipes or tubes secured together, means mounting the plurality of pipes or tubes for rotation about the axis of the inner surface with the axis being horizontally tilted so as to have a high end and a low end, means for rotating the plurality of pipes or tubes on the mounting, a feeding chute into which burnable waste material can be stacked which opens into the high end of the combustor, the pipes or tubes being interconnected for circulating water flow and having a water input line and a water/steam discharge line, means for circulating water through the lines including a steam drum connected to the discharge line for separating steam from the water, the pipes or tubes being secured so as to define a plurality of intermediate openings so that the inner surface of the combustor is gas porous, and means for delivering controlled amounts of combustion air for burning through selected portions of the porous surface, the improvement comprising, a combustor formed by multiple flat membrane wall tube panels connected to each other such that the inner surface of the combustor is multi-sided.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 1:
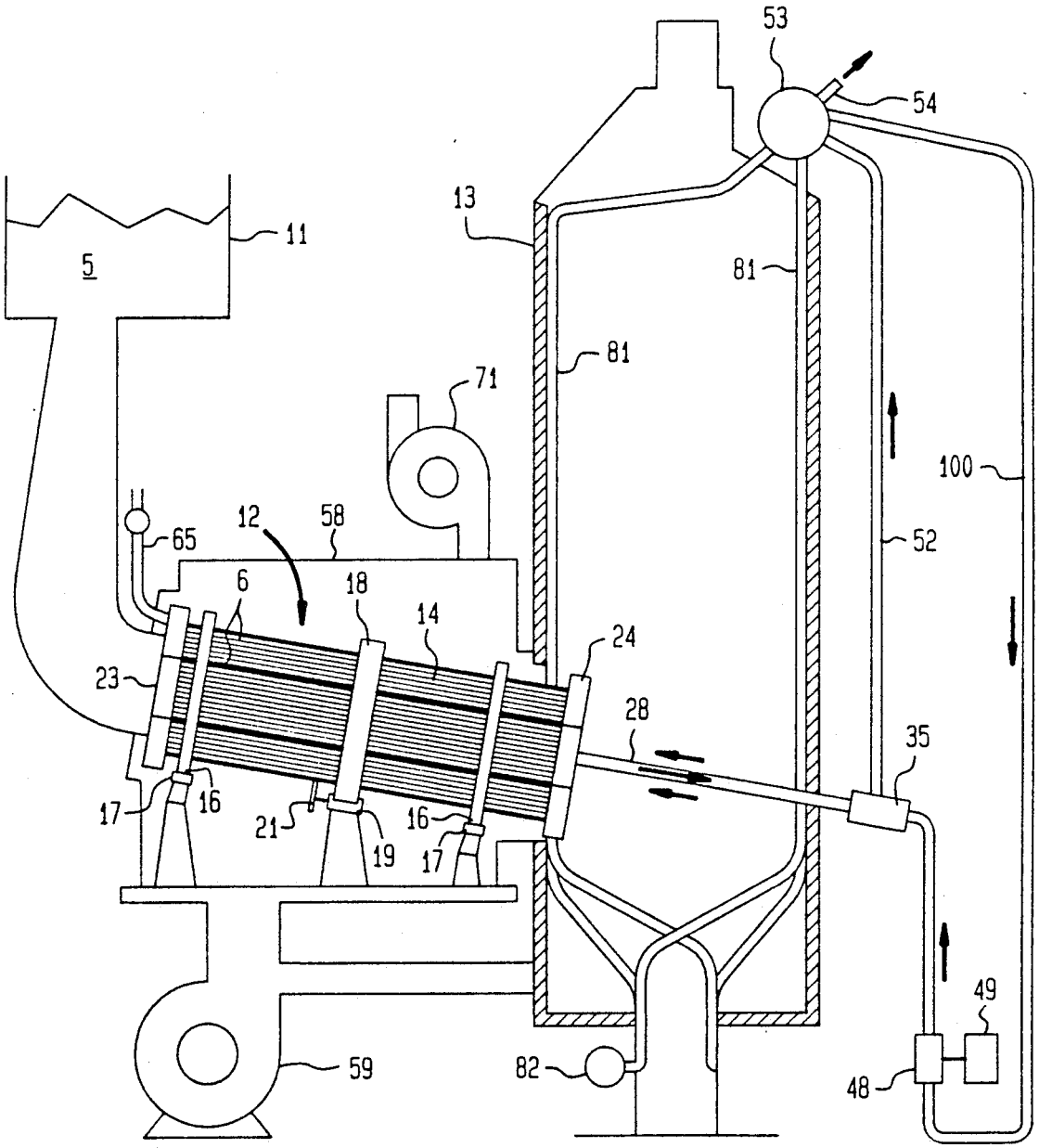
FIG. 1 is a schematic diagram of a multi-sided watercooled rotary combustor and associated structures in accordance with the present invention.

The present invention can best be described by referring to the attached drawings, wherein FIG. 1 is a schematic diagram of multi-sided watercooled rotary combustor 12 connected to boiler 13. Solid waste or refuse 5 is dumped in hopper 11, from which it falls into the upper end of combustor 12, which is horizontally tilted, where combustion begins. Combustor 12 rotates and the burning waste slowly tumbles downward forming a kind of spiraling fire bed until what has not been consumed spills into boiler 13.

Combustor 12 is formed of a plurality of flat membrane wall tube panels 6 having pipes or tubes 14 secured together to form an inner surface having a multi-sided surface 15. (See FIG. 2). A pair of cylindrical bands 16 ring pipes or tubes 14 and form tracks riding on supporting rollers 17 which mount combustor 12 for rotation, and a ring gear 18 also is fixed to pipes or tubes 14 and is meshed with a pinion 19 driven from a chain 21 so as to rotate combustor 12 on rollers 17. Pipes or tubes 14 are secured together and connected by headers 23 and 24.

Water is circulated through pipes or tubes 14 via coaxial pipe 28. Pipe 28 is disposed on the axis of the inner surface 15 of combustor 12 and runs from a rotary steam joint 35 through a right angle elbow (not shown) to header 24. Steam joint 35 is connected to line 52 which is connected to steam drum 53 at the top of boiler 13. Water supplied via pipe 100 and drum 53 is driven by pump 48 and motor 49 through all of pipes or tubes 14 defining combustor 12 and returned to drum 53 in the form of water and steam. When in operation, the water removes heat from the metal making up combustor 12 and saturated steam is extracted from the heated water in drum 53, whereupon the steam is drawn off through a line 54.

Combustor 12 is enclosed in a chamber 58 for delivering controlled amounts of combustion air, for burning, through porous surface 15. Combustion air is fed into chamber 58 by a blower 59. For starting or assisting combustion, a source 65 of additional fuel such as oil or natural gas opens into the upper end of combustor 12. Blower 71 pulls away and delivers useful volatile gases which are generated upon the burning of some solid waste materials.

Boiler 13 is lined with heat extracting boiler pipes or tubes 81 leading from water reservoirs 82.

Figure 2:
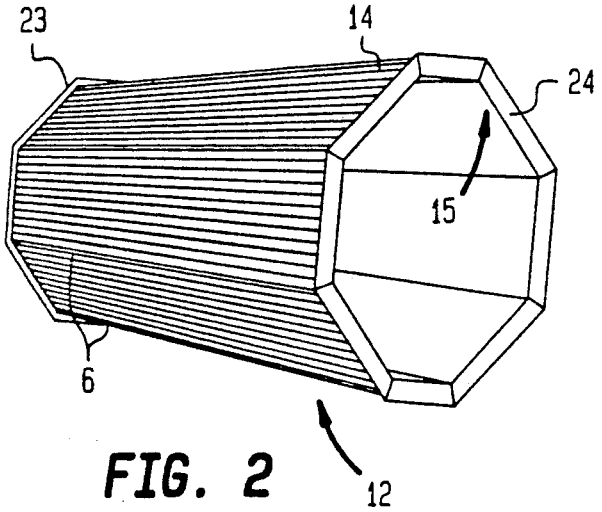
FIG. 2 is a front-side perspective view of a multi-sided watercooled rotary combustor in accordance with the present invention.
Figure 3:
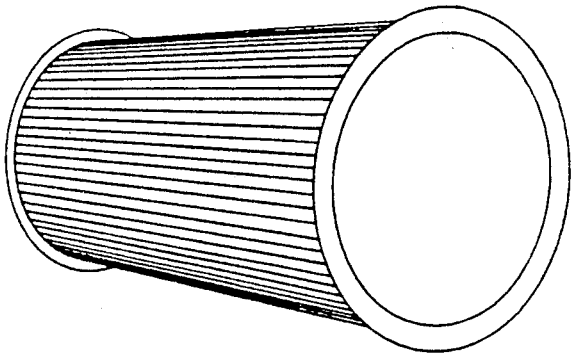
FIG. 3 (PRIOR ART)
FIG. 3 is a front-side perspective view of a conventional cylindrical watercooled rotary combustor.
Figure 5:
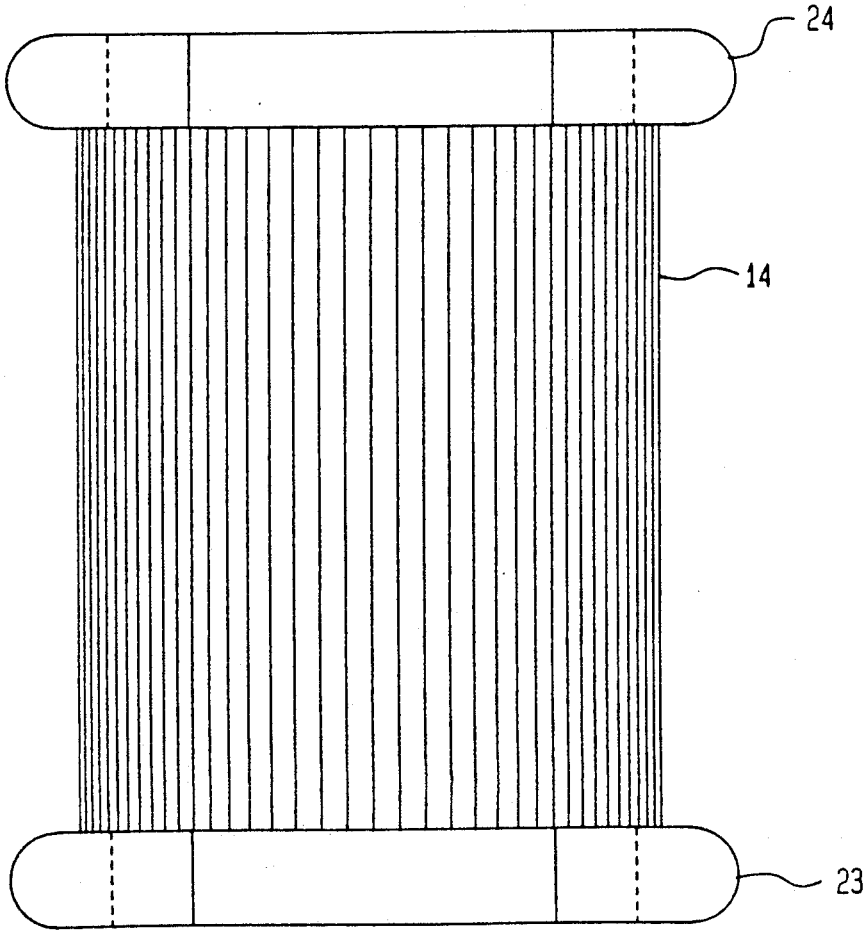
FIG. 5 is a side planar view of a multi-sided watercooled rotary combustor in accordance with the present invention.

FIG. 2 depicts the novel multi-sided watercooled rotary combustor of the present invention. This multi-sided watercooled rotary combustor 12 is shown to be octagonal in shape, although any number of sidewalls may be used. Combustor 12 is of welded wall, i.e., membrane wall, construction which comprises parallel pipes or tubes 14 and seals welded between pipes or tubes 14 to create a gas seal. The sealing material between the pipes or tubes can be of differing materials and shapes apparent to those skilled in the art. Flat metal bar material having perforations for the purpose of emitting forced draft combustion pre-heated air into the interior of combustor 12 is particularly desirable. Pipes or tubes 14 ar welded into headers 23 and 24. (See FIG. 5).

Multi-sided watercooled rotary combustor 12 is formed by flat membrane wall tube panels 6 which comprises pipes or tubes 14 and flat bar material (not shown). Panels 6 may be fabricated by automatic equipment available to most steam generation equipment manufactures. Moreover, panels 6 can be fabricated in the same manner as membrane walls for boilers since they have a flat design rather than the cylindrical design of conventional rotary combustors. By design multi-sided watercooled rotary combustor 12 eliminates all fabrication operations pertaining to the radial shaping of the membrane walls required by the design of conventional cylindrical combustors.

Figure 4:
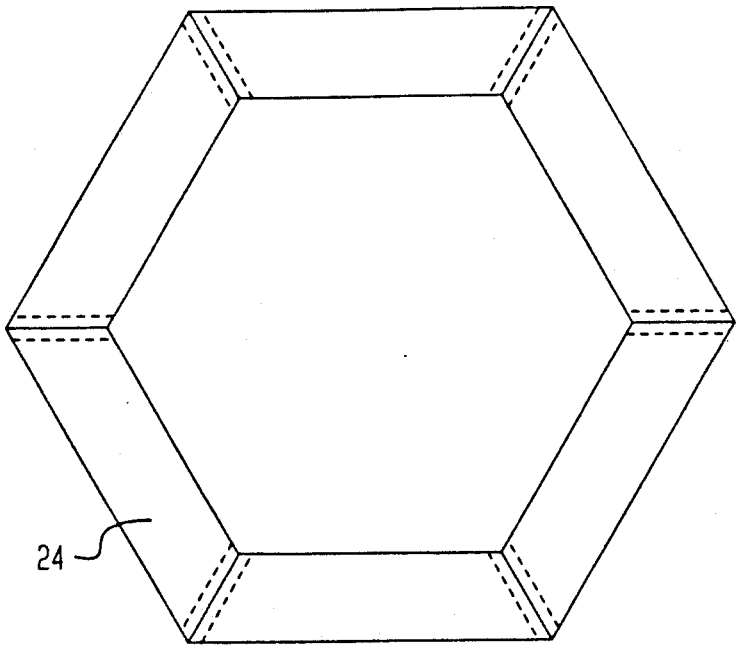
FIG. 4 is a front planar view of a multi-sided watercooled rotary combustor in accordance with the present invention.

As shown in FIG. 4, the headers used in fabricating the multi-sided watercooled rotary combustor according to the present invention comprise various straight header pieces adjoined to each other via miter joints. (See FIG. 4). Each straight header piece is associated with a flat membrane wall tube panel. The straight header pieces may be fabricated with readily available automatic equipment.

Figure 6:
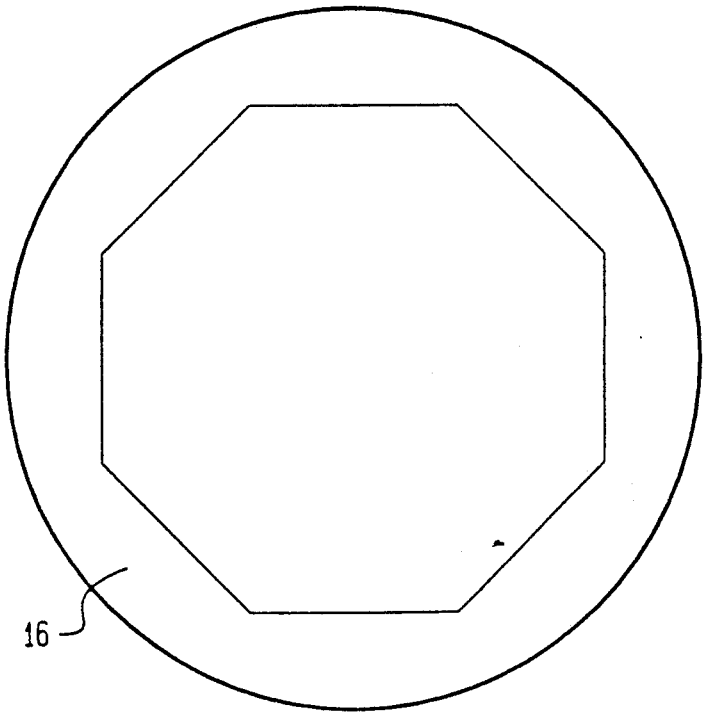
FIG. 6 is a front planar view of a multi-sided watercooled rotary combustor having a cylindrical band disposed thereabout.

FIG. 6 is a cross-sectional view of combustor 12 having an integral combustor band 16 disposed about its exterior. Combustor 12 and combustor band 16 rotate during normal operation, supported on rollers 17.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A watercooled rotary combustor comprising a plurality of pipes or tubes secured together, means mounting said plurality of pipes or tubes for rotation about the axis of the inner surface with the axis being horizontally tilted so as to have a high end and a low end, means for rotating said plurality of pipes or tubes on said mounting, a feeding chute into which burnable waste material can be stacked which opens into the high end of said combustor, said pipes or tubes being interconnected for circulating water flow and having a water input line and a water/steam discharge line, means for circulating water through said lines including a steam drum connected to said discharge line for separating steam from the water, said pipes or tubes being secured so as to define a plurality of intermediate openings so that the inner surface of said combustor is gas porous, and means for delivering controlled amounts of combustion air for burning through selected portions of said porous surface, the improvement comprising, a combustor formed by multiple flat membrane wall tube panels connected to each other such that said inner surface of said combustor is hexagonal inshape, said membrane wall tube panels comprising said pipes or tubes and a flat metal bar sealing material having perforations disposed therein which permit combustion air to be emitted into the interior of said combustor, and wherein each said flat membrane wall tube panel is connected to a straight header at each end thereof and said straight headers are connected to adjoining headers, whereby a multi-sided combustor is formed.

2. The watercooled rotary combustor according to claim 1, wherein said combustor is rotated about at least one cylindrical band disposed about the exterior surface of said combustor.

* * * * *